US007328464B2

(12) United States Patent
Lee

(10) Patent No.: US 7,328,464 B2
(45) Date of Patent: Feb. 12, 2008

(54) INFLATING AND SEPARATING DEVICE OF BODY PROTECTION AIRBAGS

(76) Inventor: Mu-Shu Lee, No.16, Alley 1, Lane 136, Sec. 1, Chongren Rd., Beitou District, Taipei City (TW)

( * ) Notice: Subject to any disclaimer, the term of this patent is extended or adjusted under 35 U.S.C. 154(b) by 138 days.

(21) Appl. No.: 11/286,725

(22) Filed: Nov. 28, 2005

(65) Prior Publication Data

US 2007/0118952 A1 May 31, 2007

(51) Int. Cl.
*A41D 1/04* (2006.01)

(52) U.S. Cl. ..... 2/456; 2/102; 441/93

(58) Field of Classification Search ..... 2/102, 2/455, 456, 463, 464, 465, 467, 411, 413, 2/462, DIG. 3; 441/88, 90, 92–94, 96
See application file for complete search history.

(56) References Cited

U.S. PATENT DOCUMENTS 4,161,797 A * 7/1979 Ruscigno ..... 441/94
5,746,442 A * 5/1998 Hoyaukin ..... 280/730.1
6,422,420 B1 * 7/2002 Brown ..... 222/5
6,766,535 B2 * 7/2004 Duhamell et al. ..... 2/102
6,951,493 B1 * 10/2005 Lu ..... 441/93

* cited by examiner

*Primary Examiner*—Tejash Patel
(74) *Attorney, Agent, or Firm*—WPAT, PC; Anthony King

(57) ABSTRACT

An inflating and separating device of body protection airbags primarily adds a hole groove in an inflating device for allowing gas to flow and connecting to a position between an inflating device and a riding object by a pulling string, and the pulling force of a separating device can be adjusted, such that if a rider has an accident and falls out from the motorcycle, or an excessively large force is produced, the inflating device and the separating device will be triggered in sequence instantaneously to achieve the effect of completing the inflation of the airbag quickly and prevent the rider from being dragged by the riding object and protect the rider's body.

2 Claims, 8 Drawing Sheets

INFLATING AND SEPARATING DEVICE OF BODY PROTECTION AIRBAGS

FIELD OF THE INVENTION

The present invention relates to an inflating and separating device of body protection airbags, and more particularly to an inflating and separating device that will be triggered instantaneously when a rider has an accident or an excessively large force is produced, so as to achieve the inflation of an airbag to prevent the rider from being dragged by the riding object and protect the rider's body.

BACKGROUND OF THE INVENTION

As more attentions are paid to the concept of protecting our life, protective equipments used for driving different transportation means become more popular accordingly, and these protective means include collision-resisting bars, safety airbags, and anti-lock brake systems (ABS) and the like. These safety equipments can maximize the effect of protecting the safety of the driver or the passengers when the vehicle is driven normally.

However, laws are established to regulate all motorcycle riders to wear a safety hamlet in most countries including Taiwan, but when accidents occur, simply protecting the rider's head is insufficient for effectively preventing the rider or passenger from being injured, because the rider usually falls with the motorcycle or bounces out from the seat. As a result, ribcage fractures, internal injuries, internal bleeding, spinal or neck injuries may occur. To minimize the injury of the rider or passenger, there is a safety product introduced to the market. This product can inflate an airbag which can effectively protect the rider's body. The level of injury caused by an accident depends on the speed of inflating the airbag. However, the inflating device and separating device of such product still has drawbacks, and the airbag cannot be inflated before injuries occur. Thus, the products of this sort cannot effectively prevent internal injuries, internal bleedings, or spinal or neck injuries of the rider during a collision.

Referring to FIG. 1 for the cross-sectional view of a structure of a prior art inflating and separating device of body protection airbags for riders, the air airbag 3 includes a joint 31 disposed at an appropriate position, and the joint 31 is rotarily connected to an inflating device 1, and the inflating device 1 includes a ventilated duct 11 interconnected to a connecting hole 12 and using the connecting hole 12 to interconnect the joint 31. An end of the ventilated duct 11 is rotarily connected to a compressed gas cylinder 4, and the interior of the ventilated duct 11 includes a firing pin 111 movably installed towards the compressed gas cylinder 4, and the firing pin 111 passes into a spring 112 for providing a resuming resilience, and the other end of the firing pin 111 installs a striking device 13, and the striking device 13 includes a pulling handle 131 having an open end and latched with a transversal rod 114, and a corresponding safety hole 14 is disposed on the inflating device 1 and the pulling handle 131 and inserted inwardly with a breakable safety insert bolt, and the ends of the inflating device 1 and the pulling handle 131 separately have a hole 136 for tying a pulling string 21, and another end of the pulling string 21 includes a buckle 22 to define a separating device 2 for hooking to the seat or any other appropriate position of the motorcycle.

Further, the ventilated duct 11 of the inflating device 1 installs a leakproof ring 113 for preventing gas leaks, so that if a rider has an accident and falls out from the motorcycle, the pulling handle 131 will pull the pulling string 21 immediately, and pull the breakable safety insert bolt in the safety hole 14 apart to press the striking device 13 by the principle of lever to strike the firing pin 111, and further pierce the sealed opening 41 of the compressed gas cylinder 4. Now, the pulling handle 131 of the striking device 13 having an open end is used for separating the inflating device 1 quickly. The firing pin 111 resumes its original position by the resilience of the spring 112 after the spring 112 is compressed, and the air in the compressed gas cylinder 4 enters the airbag 3 through the ventilated duct 11 and the connecting hole 12 quickly to complete the inflation, such that the effect of the air-cushion can protect the rider's body.

In the foregoing cabled mechanical inflating device 1, the pulling string 21 is pulled to drive the pulling handle 131 as well as the gravitational acceleration produced during an accident will pull the breakable insert bolt in the safety hole 14 apart and pull the pulling handle 131 slantingly outward, so as to continuously produce the striking and inflating actions. In the meantime, the pulling handle 131 having an open end uses its opening to separate the transversal rod 114 quickly and thus dragging with each other will not occur.

In the foregoing structural design, the shortcomings are summed up as follows:

1. When the firing pin in the striking device pierces the compressed gas cylinder sealed opening, the firing pin usually blocks the piercing hole, so that it is difficult for the gas to pass successfully through the piercing hole into the airbag and achieve the purpose of a quick inflation.
2. Gas is discharged from the pierced hole, such that the speed of inflating the airbag slows down, and thus having an adverse effect on protecting the rider's body.
3. It is troublesome to use the breakable insert bolt for safety. If the breakable insert bolt is pulled apart by accident, it is necessary to buy a new insert bolt, and it is not time-effective for a device that must be used immediately.
4. Although the striking device can use a pulling handle at the front end having an open end to separate with the transversal rod, the falling direction is uncertain when the accident occurs, and thus the open end of the pulling handle cannot be separated from the transversal rod, and the rider cannot be separated from the vehicle quickly. As the result, the rider may be dragged by the vehicle and thus causing dangers to the rider's safety.

In view of the foregoing shortcomings, the inventor of the present invention based on years of experience in the related field to conduct researches to overcome the foregoing shortcomings, and finally developed an inflating and separating device for body protection airbags, and more particularly referring to an inflating and separating device that will be triggered instantaneously when a rider has an accident or an excessively large force is produced, so as to achieve the inflation of an airbag to prevent the rider from being dragged by the riding object and protect the rider's body.

SUMMARY OF THE INVENTION

Therefore, it is a primary objective of the present invention to design an instant inflating device of a body protection airbag, such that if a rider has an accident and falls out from the motorcycle, and an excessively large force is produced, then the inflating device will be triggered instantaneously to achieve the effect of quickly completing the inflation of the airbag.

A secondary objective of the present invention is to design a separating device of a body protection airbag, more particularly a design that can trigger the inflating device and then the inflating device if a rider has an accident and falls out from the motorcycle, and an excessively large force is produced, so as to prevent the rider from being dragged by the riding object and protect the rider's body.

A further objective of the present invention is to design an inflating and separating device of body protection airbags, more particularly to a design that switches the cable mechanical device and uses a plurality of concave and convex semicircular structures to achieve a sectional safety when a rider has an accident and falls out from a motorcycle, so as to prevent the inflating and separate device from being triggered by accident while the rider gets on or off the motorcycle.

To achieve the foregoing objectives, the inflating and separating device of body protection airbags in accordance with the present invention adds a hole grooves disposed in the inflating device for allowing air to flow and connected between the inflating device and the riding object by a pulling string, and the pulling force of the separating device can be adjusted automatically, such that if the rider has an accident and falls out from a motorcycle, and an excessively large force is produced, then the inflating device and separating device will be triggered successively, so as to achieve the effect of quickly completing the inflation of the airbag and prevent the rider from being dragged by the riding object to protect the rider's body.

DETAILED DESCRIPTION OF THE PREFERRED EMBODIMENTS

To make it easier for our examiner to understand the objective of the invention, its structure, innovative features, and performance, we use a preferred embodiment together with the attached drawings for the detailed description of the invention.

Figure 1:
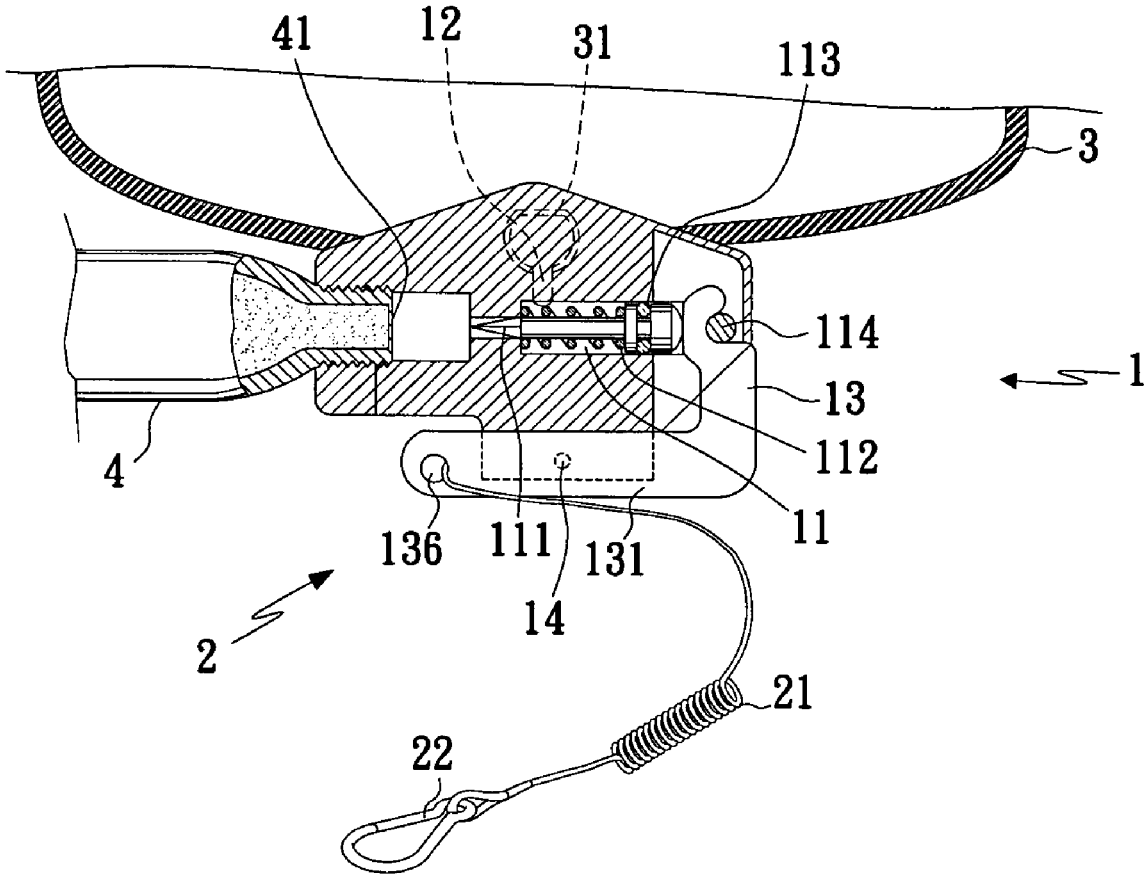
FIG. 1 is a cross-sectional view of a prior art inflating and separating device of body protection airbags for riders.
Figure 2:
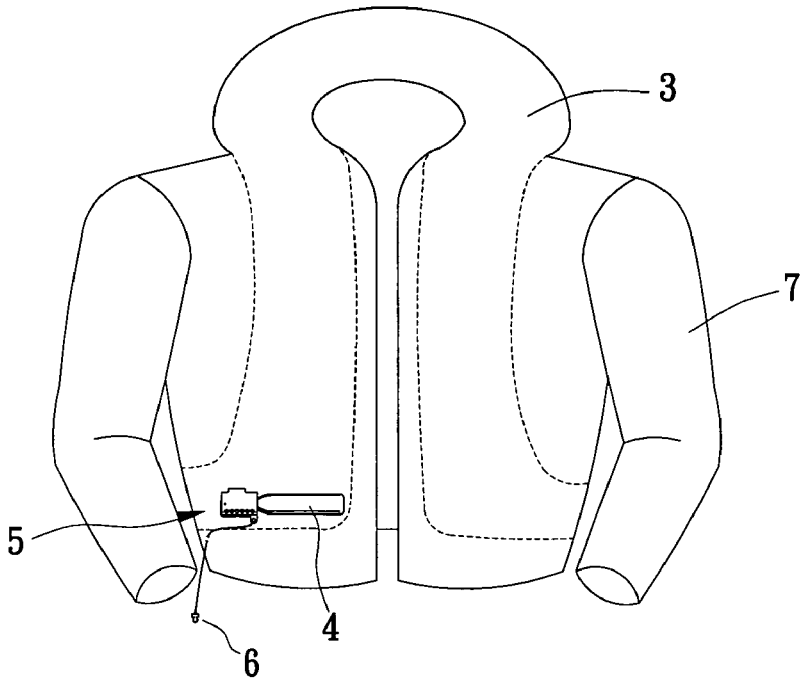
FIG. 2 is a schematic front view of clothes being inflated according to the present invention.
Figure 3:
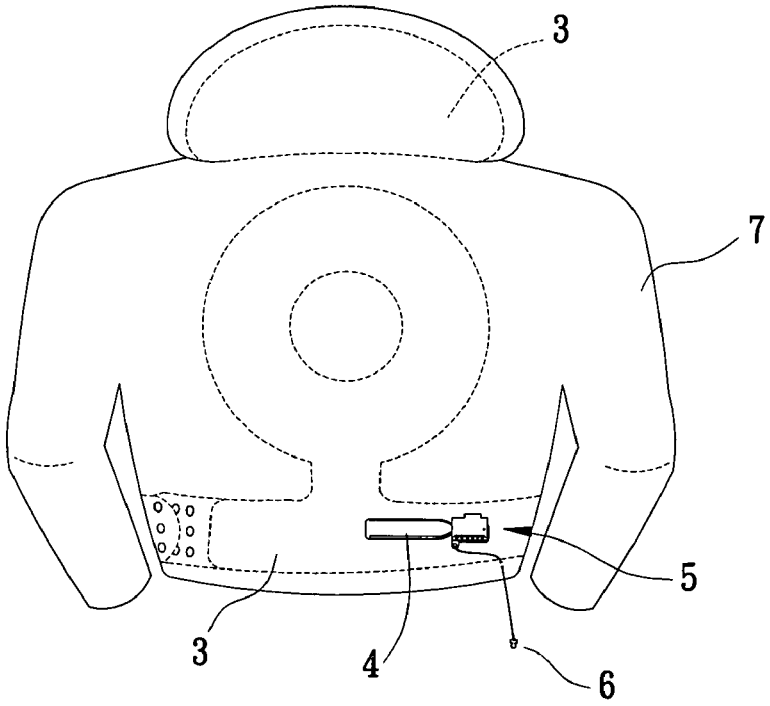
FIG. 3 is a schematic rear view of clothes being inflated according to the present invention.

Referring to FIGS. 2 and 3 respectively for the schematic front view and schematic back view of the device of the present invention being installed in clothes, the present invention comprises a set of airbag 3 installed inside a rider's clothes 7, and the layout of the airbag 3 covers and protects the key position of the rider such as the rider's chest, abdomen, spine, and neck, and the design has taken the wearing comfort into consideration. Of course, the present invention is not limited to this preferred embodiment only.

Figure 4:
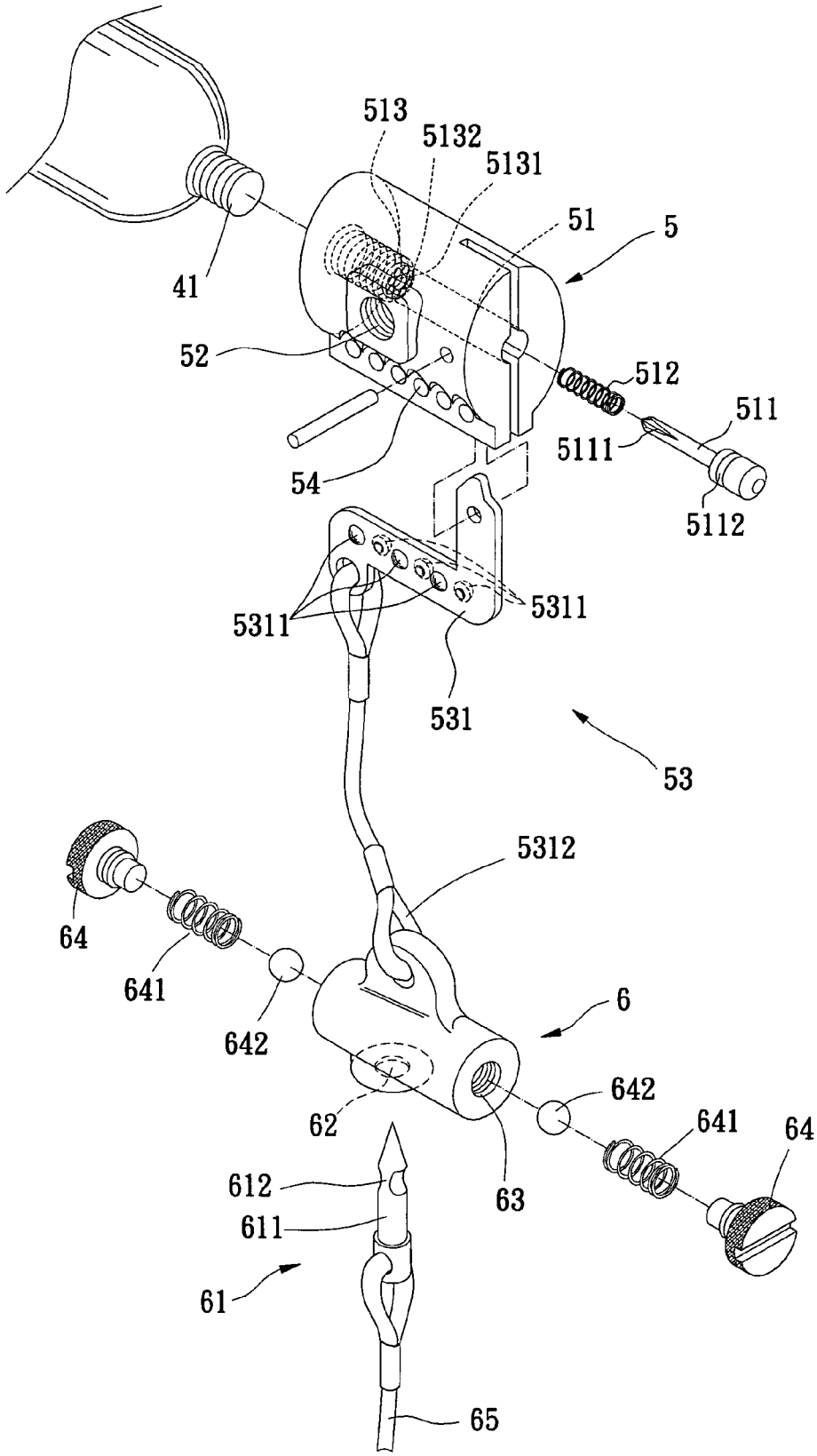
FIG. 4 is an exploded view of an inflating device and a separating device according to the present invention.
Figure 5:
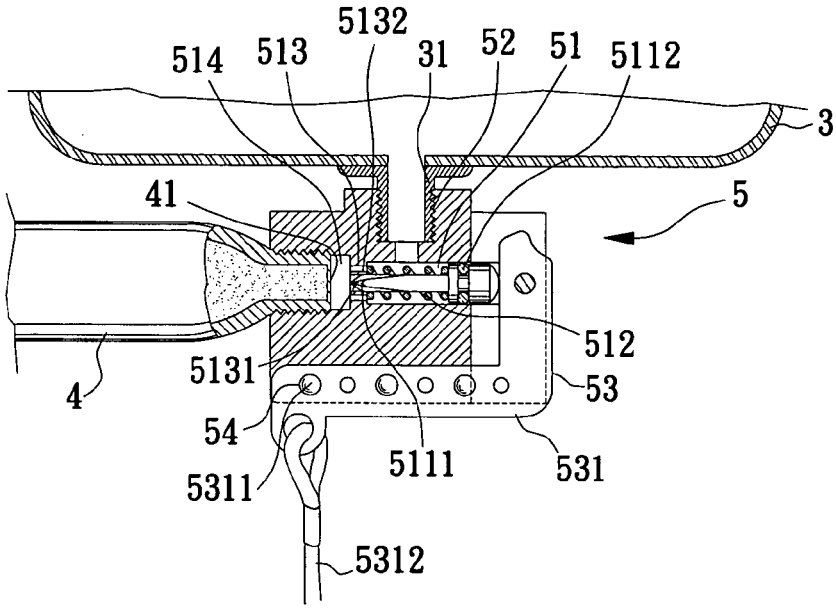
FIG. 5 is a cross-sectional view of the structure of an inflating device according to the present invention.
Figure 6:
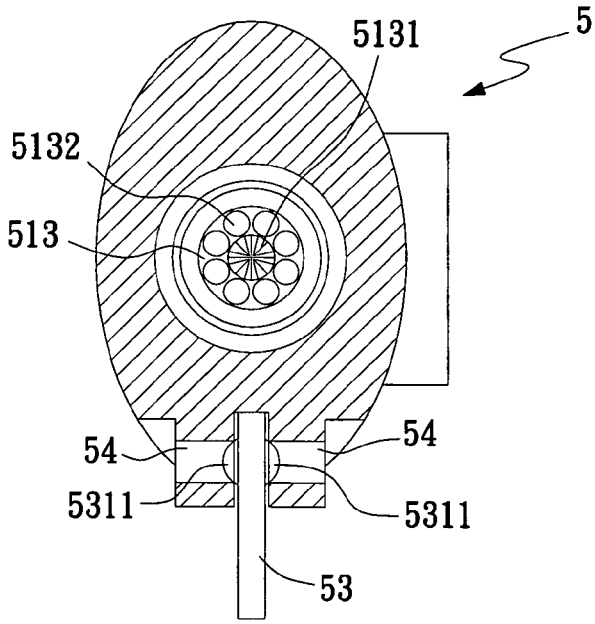
FIG. 6 is a side view of an inflating device according to the present invention.

Referring to FIG. 4 for the exploded view of the structure of an inflating device and a separating device of the invention and FIGS. 5 and 6 for the cross-sectional view and the side view of the inflating device of the invention, the airbag 3 comprises a joint 31 disposed at an appropriate position and rotarily coupled to an inflating device 5, and the inflating device 5 includes a ventilated duct 51, and a connecting hole 52 interconnected with the ventilated duct 51 for rotarily connecting the connecting hole 52 with the joint 31. An end having the ventilated duct 51 is movably coupled to a firing pin 511 disposed inside a compressed gas cylinder 4 and having its tip facing a sealed opening 41 of the compressed gas cylinder 4, and the center of the ventilated board 513 has a firing pin penetrating hole 5131 and two or more vent holes 5132 are disposed at the periphery of the firing pin penetrating hole 5131, and a gas leaking space 514 is reserved between the sealed opening 41 and the ventilated board 513, and the lateral surface of the tip of the firing pin 511 includes a plurality of grooves 5111 and the rear end includes a leakproof ring 5112, and a spring 512 is passed through for providing a resuming resilience, wherein the design of the plurality of grooves 5111 is provided for moving the firing pin 511 forward and backward, while having a quick inflating function, and a striking device 53 is installed at another end and the striking device 53 includes a pulling handle 531, and at least one set of corresponding holes 54 and protruded point 5311 is disposed on the inflating device 5 and the pulling handle 531 for providing sectional safety, and an end of the pulling handle 531 is tied with a pulling string 5312.

Figure 7:
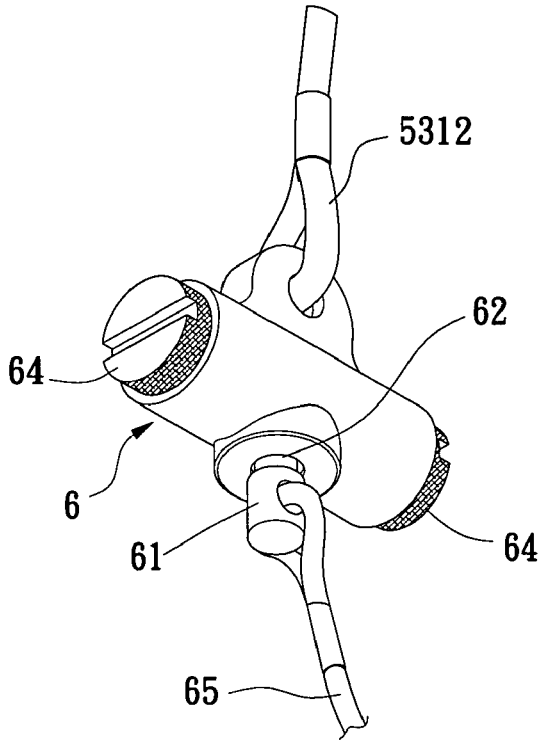
FIG. 7 is a perspective view of a separating device according to the present invention.
Figure 8:
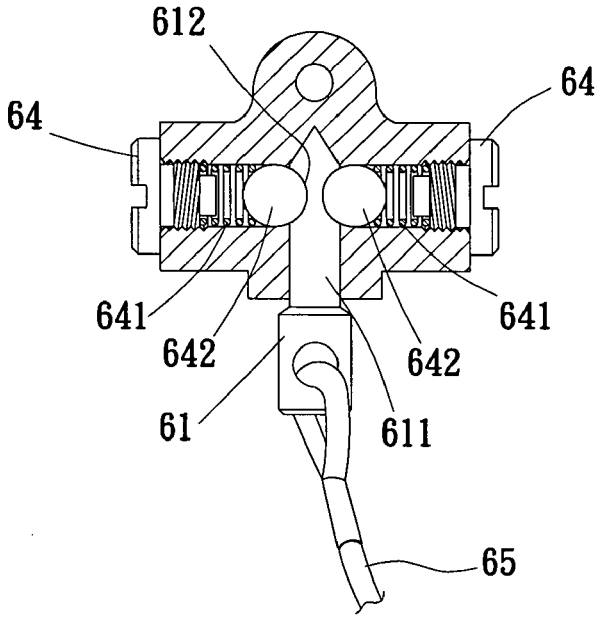
FIG. 8 is cross-sectional view of a separating device according to the present invention.

Referring to FIGS. 4, 7 and 8 for the exploded view of the structure of an inflating device and a separating device and the perspective and cross-sectional views of the structure of a separating device in accordance with the present invention, another end of the pulling string 5312 is fixed to a separating device 6, and the separating device 6 is in the shape of a hollow pipe and includes two insert bolts 61 of symmetric arc grooves having an insert end 611 and disposed at the bottom of the separating device 6 for inserting each insert bolt 61 into a pin hole 62, and both sides of the separating device separately include a lockhole 63 for rotarily securing a screw bolt 64, and a steel ball 642 and spring 641 are placed respectively from both sides of the lockhole 63 before the screw bolt 64 is secured. The screw bolt 64 is secured to block and fix the steel ball 642 in the arc groove 612 of the insert bolt 61, and the screw bolt 64 is secured or loosened which is the pulling force according to the rider's body weight and the riding object. The bottom of the insert bolt 61 is connected to another pulling string 65 having a buckle 22 for hooking onto a seat of the motorcycle or any other appropriate position.

The protruded point 5311 of the pulling handle 531 provided for safety is engaged with the hole 54 of the inflating device 5 provided for safety, so that if a rider has an accident and falls out from a motorcycle, the pulling handle 531 is pulled by the pulling string 5312 to separate a plurality of protruded points 5311 in sequence from the holes 54 and press the striking device 53 by the principle of lever to strike the firing pin 511 and further pierce the sealed opening 41 of the compressed gas cylinder 4. Now, the air in the compressed gas cylinder 4 is leaked from a groove 5111 of the firing pin 511 to the gas leaking space 514 immediately after passing through the pierced sealed opening 41, and the gas passes through each venthole 5132, ventilated duct 51, and connecting hole 52 on the ventilated board 513 and enters into the airbag 3 for the inflation. After the foregoing actions, the firing pin 511 will be drawn back to the position of the sealed opening 41 due to the resilience of the compressed spring 512, such that the air in the compressed gas cylinder 4 can be leaked out from the hole pierced by the firing pin 511 more quickly, so as to achieve the effect of instantaneously completing the inflation of the airbag 3, and the airbag 3 has the effect of a air-cushioned buffer to protect the rider's body.

In the cabled mechanical separating device 6, if the pulling string 5312 pulls the pulling handle 531 to move, the gravitational acceleration produced by the accident will separate the plurality of protruded points 5311 from the holes 54 and press the striking device 53 by the principle of lever to strike the firing pin 511. After the striking action is completed, the pulling string 5312 pulls the separating device 6 apart, and an end of the separating device 6 is fixed to the riding object by the pulling force of the pulling string 65, and the other end is fixed to the rider by the pulling force of the pulling string 5312. If the pulling force of the separating device 6 reaches a predetermined force, then the insert bolt 61 will be separated from the pin hole 62 automatically, so as to achieve the effects of separating the rider with the riding object and preventing the rider from being dragged by the riding object.

Further, the structure having several sets of protruded point 5311 and hole 54 engaged in sequence is used as a sectional precaution and safety. If the rider forgets the connection between the pulling string 65 and the riding object when the riders gets off from the riding object, then the pulling string 5312 will be used to pull apart the first set of protruded point 5311 and hole 54 as a first-stage warning, and then the second set of protruded point 5311 and hole 54 will be pulled apart as a second-stage warning, and so on. Until the last set of protruded point 5311 and hole 54 is used for the last warning, such design reminds the rider to release the pulling string 65 to avoid triggering the inflation by mistake or negligence. Furthermore, the sets of protruded point 5311 and hole 54 can be engaged with each other immediately. Such design of having several sets of protruded point 5311 and hole 54 also can come with an adjustment to the pulling force, and the adjustment can be made to the number of sets of protruded point 5311 and hole 54 according to the rider's body weight. The heavier the body weight, the more is the number of sets. However, if the pulling force is increased, the separating device 6 must be adjusted accordingly, so that the pulling force must be larger than that of the inflating device 5, and prevents the rider from being separated from the riding object while the inflating device 5 is still opening the several set of safety device.

Figure 9:
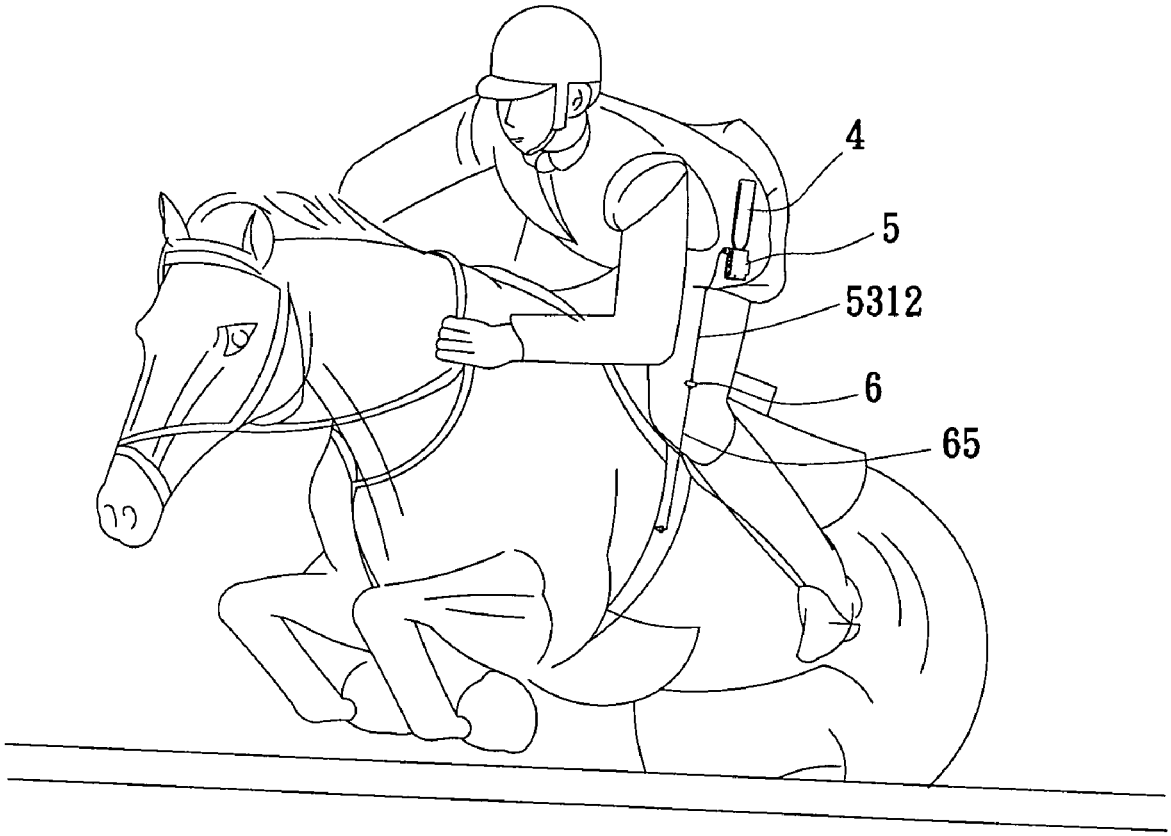
FIG. 9 is schematic view of an application of the present invention.
Figure 10:
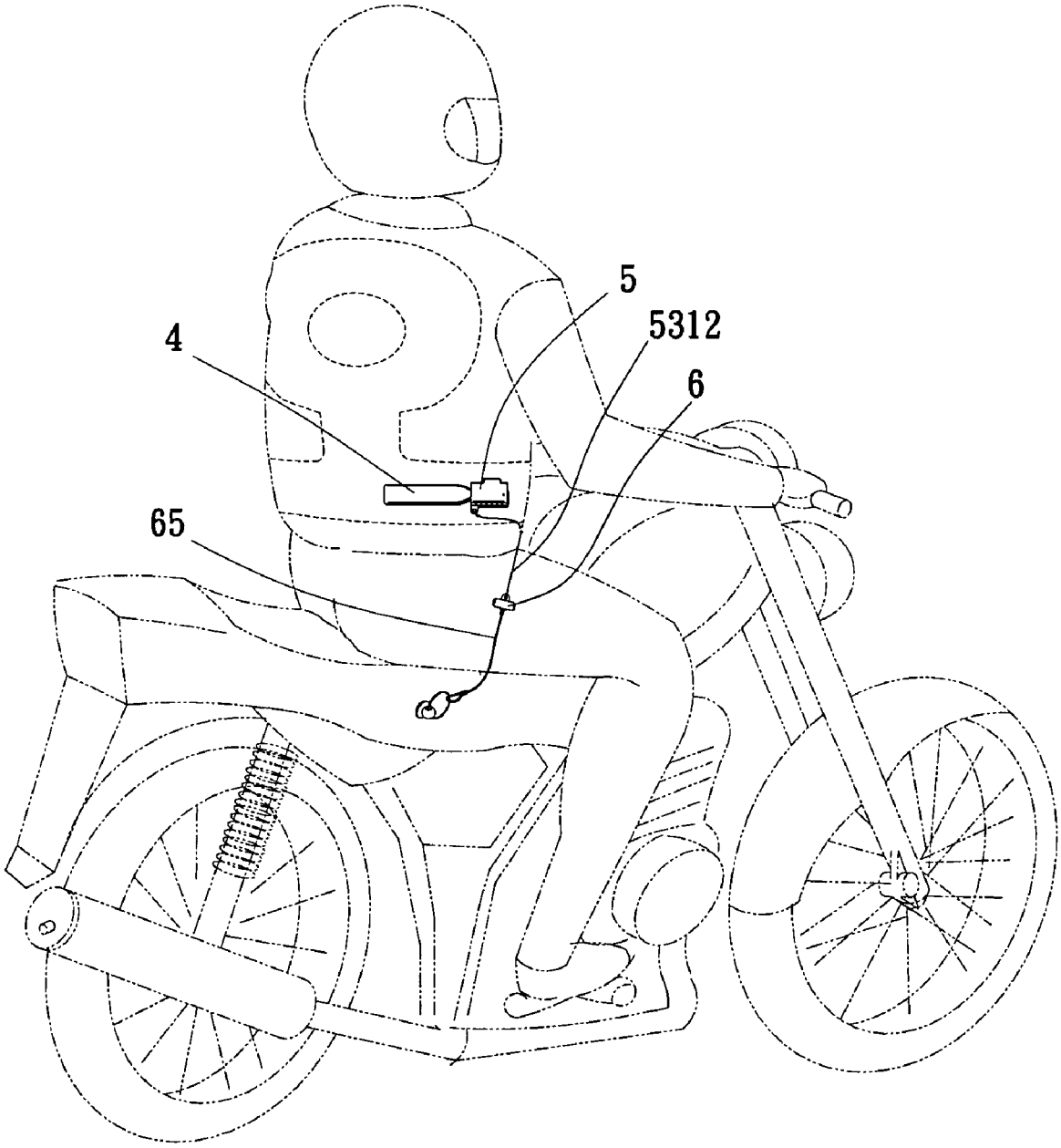
FIG. 10 is a schematic view of another application of the present invention.
Figure 11:
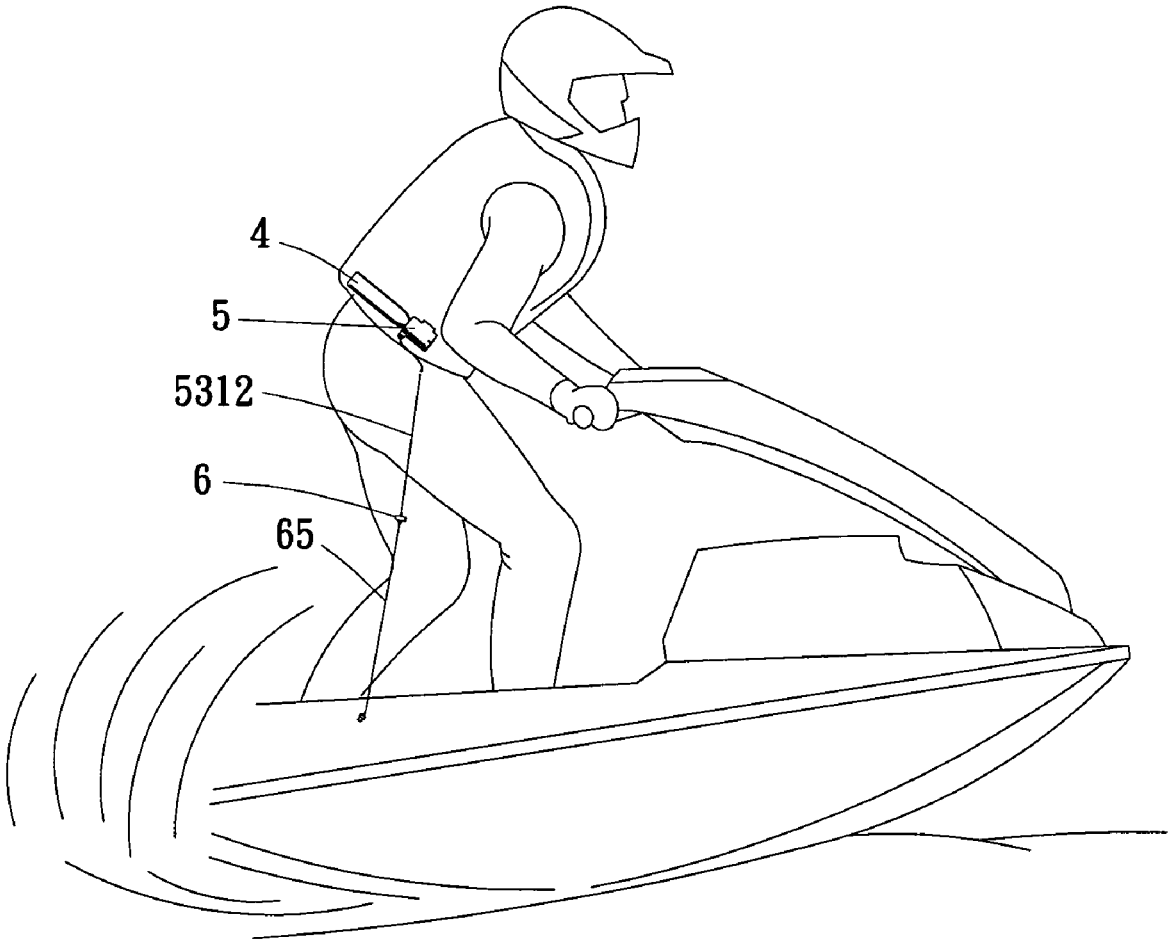
FIG. 11 is a schematic view of a further application of the present invention.

From the improved structure of the aforementioned inflating and separating device of body protection airbags for riders regardless of being a device attached on the rider's clothes or a stand-alone device can be used for riding motorcycle, riding horse, skiing, boating, mountain climbing or deep sea fishing (refer to FIGS. 9, 10, and 11 for some of its applications). The device can immediately completes the inflation when the rider falls out from the motorcycle or other riding object, such that an air-cushioned buffering force and the separation with the riding object can separate the rider from the riding object and prevent the rider from being dragged by the riding object, so as to protect the rider's body.

In view of the description above, the present invention is useful and novel in the industry, and has improvements over the prior arts.

While the invention has been described by way of example and in terms of a preferred embodiment, it is to be understood that the invention is not limited thereto. To the contrary, it is intended to cover various modifications and similar arrangements and procedures, and the scope of the appended claims therefore should be accorded the broadest interpretation so as to encompass all such modifications and similar arrangements and procedures.

What is claimed is:

1. An inflating and separating device of body protection airbags for riders, having a joint connected to the interior of an airbag and coupled to an inflating device, and an end of the inflating device being coupled to a compressed gas cylinder, a firing pin being disposed inside and movably installed at a position facing said compressed gas cylinder, and another end including a striking device pivotably coupled to the inflating device, wherein said striking device having a pulling handle for pushing said firing pin, and at least one hole being disposed at a connecting position of said pulling handle, characterized in that: said inflating device is coupled to an end of said compressed gas cylinder having a ventilated board with at least two ventholes, and a gas leaking space is disposed between a sealed opening and said ventilated board of said compressed gas cylinder, and a plurality of grooves is disposed at a lateral side of the tip of said firing pin, a leakproof ring disposed at a rear end of said firing pin, such that the gas in said compressed gas cylinder can inflate a space of said airbag immediately after said firing pin pierces said sealed opening and then after said firing pin is withdrawn to the position of said sealed opening, and wherein said pulling handle of said striking device includes a plurality of corresponding holes for engaging and detachable coupling with at least one protruded points disposed on the inflation device, wherein selective use of varied number of said protruded points allows for the adjustment of a first pulling force necessary to move said pulling handle, and said pulling handle has an end coupled to a first end of a pulling string, and a second end of the pulling string is coupled to a mid-portion of a separating device, and said separating device is in the shape of a hollow pipe having two terminal ends and a pin hole disposed transverse to a longitudinal axis of the hollow pipe for inserting an insert bolt which has an insert end that has two symmetrical arc grooves, and both terminal ends of said separating device respectively include a first and second lockholes for securing a first and second screw bolts, a first and second circular members being biased towards each other by a first and second springs disposed within said first and second lockholes, and said first and second screw bolts biase said first and second springs so that said circular members bias against said arc grooves of said insert bolt, and the tightness of the biasing force by said first and second circular members can be adjusted by turning said first and second screw bolts according to a rider's body weight and a riding object to set a second pulling force, and said second pulling force is larger than the first pulling force of triggering said striking device, and wherein the insert bolt is coupled to a cord which is attachable to said riding object.

2. The separating device of body protection airbags for riders of claim 1, wherein said circular member is a steel ball.

* * * * *